United States Patent [19]

Johnson

[11] 4,435,229

[45] Mar. 6, 1984

[54] METHOD OF PREPARING A TWO-WAY SHAPE MEMORY ALLOY

[76] Inventor: Alfred D. Johnson, 5383 Bancroft Ave., Oakland, Calif. 94601

[21] Appl. No.: 308,127

[22] Filed: Oct. 2, 1981

Related U.S. Application Data

[63] Continuation of Ser. No. 78,891, Sep. 25, 1979, abandoned.

[51] Int. Cl.[3] ..... C22F 1/00; C22F 1/10

[52] U.S. Cl. ..... 148/11.5 R; 148/11.5 N; 148/402

[58] Field of Search ..... 148/402, 11.5 R, 11.5 F, 148/11.5 N, 131, 132, 426; 420/451

[56] References Cited

U.S. PATENT DOCUMENTS

| | | | |
|---|---|---|---|
| 3,558,369 | 1/1971 | Wang et al. | 148/133 |
| 3,594,239 | 7/1971 | Wang | 148/133 |
| 3,652,969 | 3/1972 | Willson et al. | 148/11.5 N |
| 3,748,197 | 7/1973 | Willson et al. | 148/11.5 F |
| 3,753,792 | 8/1973 | Tyler | 148/131 |
| 3,802,930 | 4/1974 | Brook et al. | 420/402 |
| 3,948,688 | 4/1976 | Clark | 148/11.5 R |
| 3,953,253 | 4/1976 | Clark | 148/11.5 R |
| 4,010,455 | 3/1977 | Stange | 148/402 |
| 4,304,613 | 12/1981 | Wang et al. | 148/11.5 N |

*Primary Examiner*—Peter K. Skiff

*Attorney, Agent, or Firm*—Flehr, Hohbach, Test, Albritton & Herbert

[57] ABSTRACT

A two-way shape memory alloy, a method of training a shape memory alloy, and a heat engine employing the two-way shape memory alloy to do external work during both heating and cooling phases. The alloy is heated under a first training stress to a temperature which is above the upper operating temperature of the alloy, then cooled to a cold temperature below the zero-force transition temperature of the alloy, then deformed while applying a second training stress which is greater in magnitude than the stress at which the alloy is to be operated, then heated back to the hot temperature, changing from the second training stress back to the first training stress.

28 Claims, 8 Drawing Figures

METHOD OF PREPARING A TWO-WAY SHAPE MEMORY ALLOY

The Government has rights in this invention pursuant to Contract No. W-7405-ENG-48, awarded by the U.S. Department of Energy.

This is a continuation, of application Ser. No. 78,891 filed Sept. 25, 1979, now abandoned.

This invention relates to shape memory alloys which convert heat energy into mechanical work.

Heat engines have heretofore been developed which employ metallic alloys having a shape memory effect, known as shape memory alloys or materials. A shape memory alloy commonly employed in such engines is Nitinol, which is alloyed of nearly equal atomic amounts of nickel and titanium. These heat engines generally operate on the principle of cyclically deforming the shape memory alloy while it is below its transition temperature and then heating it to above its transition temperature. During the heating cycle the alloy recovers all or part of the deformation and in the process does work on its environment. In this method of operation the work done by the alloy during the shape memory recovery is much greater than that necessary to cause the deformation at the lower temperature so that a net conversion of heat to mechanical energy results.

The previously known solid-state engines of the above type are comprised of one or more shape memory effect elements which are cycled thermally hot and cold by a system of levers, pulleys or other mechanical linkages which also deform the elements (that is, do work on them) when cold, and extract work from them when they are heated. Heretofore memory alloy heat engines have been limited in power and work output ratings due to the use of one-way shape memory alloys which can extract work only during the heating phase of the cycle.

It is a general object of the present invention to provide a shape memory material having a two-way shape memory and capable of doing external work when cooled below its transition temperature and also when heated above its transition temperature.

Another object is to provide a method of training a shape memory alloy to provide such a two-way shape memory.

Another object is to provide a heat engine employing a shape memory alloy having two-way shape memory which extracts work during both the heating and cooling phases of the cycle.

The invention in summary includes a two-way shape memory alloy, a method of training a two-way shape memory alloy and a heat engine employing such an alloy. The method of training is as follows: a naive shape memory alloy is brought under a first training stress to a hot temperature which is above the upper operating temperature of the alloy. The alloy is then cooled to a cold temperature which is below the zero-force transition temperature of the alloy. The alloy is then deformed at the cold temperature while applying a second training stress which is greater or equal in magnitude than the stress at which the alloy is to be operated in the heat engine. The alloy is then heated back to the hot temperature, and the stress is changed back to the first training stress. The steps are repeated a predetermined number of cycles until the trained two-way shape memory alloy is produced. In one embodiment the trained alloy is employed in an engine which torsionally deforms the alloy first in one rotational sense during a heating phase and which then torsionally deforms the alloy in an opposite rotational sense during a cooling phase. External work is produced by the alloy during both phases of the cycle.

The foregoing objects and features of the invention will appear from the following specification in which the several embodiments have been set forth in conjunction with the accompanying drawings.

Certain shape memory alloys, notably Nitinol, exhibit a two-way shape memory if trained in accordance with the present invention. Such memory alloys have two natural shapes, one shape when at a cold temperature below the transition temperature and another shape when at a hot temperature above the transition temperature. In general both of these shapes may be different from the original untrained or "naive" shape.

Figure 1:
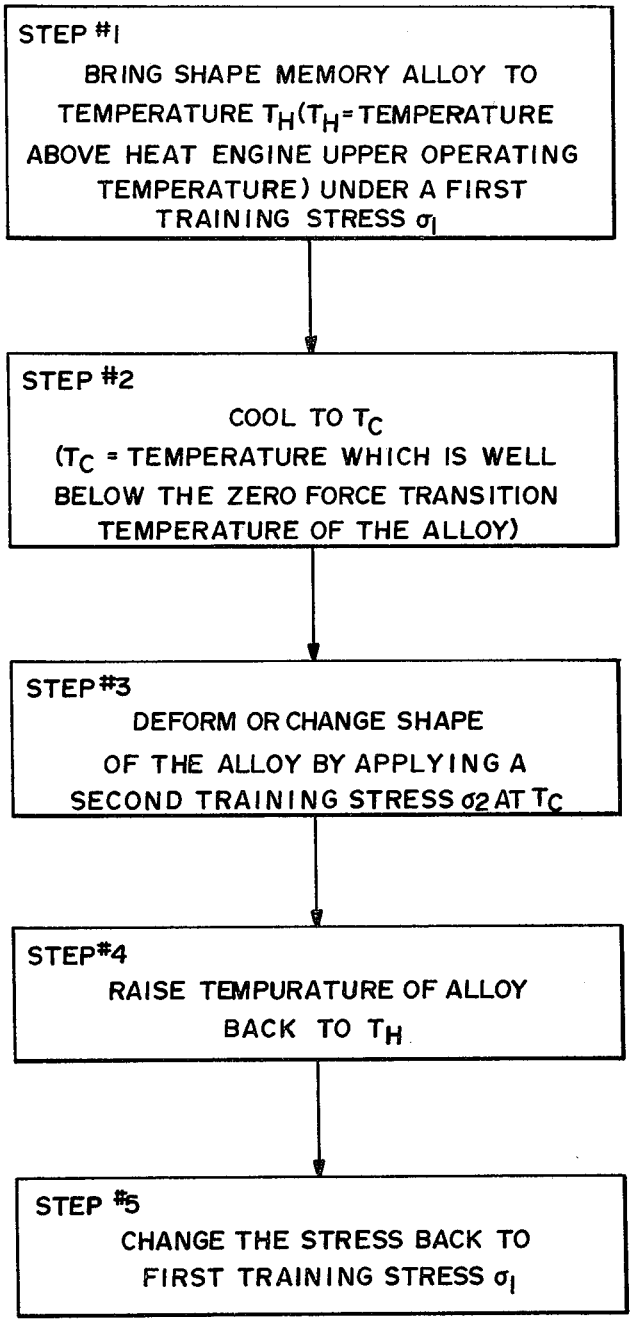
FIG. 1 is a flow diagram depicting the method of training a two-way shape memory alloy.

FIG. 1 depicts the training method of the present invention by which a two-way shape memory alloy is formed. The naive alloy material, e.g. Nitinol or other shape memory materials such as CuAlNi alloy, is in a suitable configuration, e.g. a wire, hollow cylinder, flat bar or spiral or helical shape. For initiating training one may bring the alloy material to a hot temperature $T_H$ under a first training stress $\sigma_1$. The temperature $T_H$ is above the upper operating temperature T for the heating cycle when the alloy is to be employed in the heat engine. In the training, the alloy is next cooled to a temperature $T_C$ which is well below the zero force transition temperature of the alloy, as in step #2 of FIG. 1. In the next step the alloy is deformed or caused to undergo a shape change by applying a second training stress $\sigma_2$ at temperature $T_C$ where $\sigma_2 \neq \sigma_1$ (the expression $\sigma_2 \neq \sigma_1$ includes both cases of the stresses having different magnitudes as well as the stresses being applied in opposite senses). The second training stress is equal to or greater in magnitude than the stress $\sigma$ at which the alloy is to be operated in the cycle of the heat engine. In the next step the temperature of the alloy is raised back to $T_H$, which causes it to contract while applying a maximum training stress; external work is done by the alloy during this step. In the final step of the training cycle the stress is substantially reduced while holding the temperature $T_H$ substantially constant. The foregoing steps are repeated for a predetermined number of cycles N to produce the alloy having the two-way shape memory. The number of cycles N depends on factors such as the size, shape and composition of the memory alloy as well as the end use application. Typically, N may be on the order of ten or more cycles.

Figure 2:
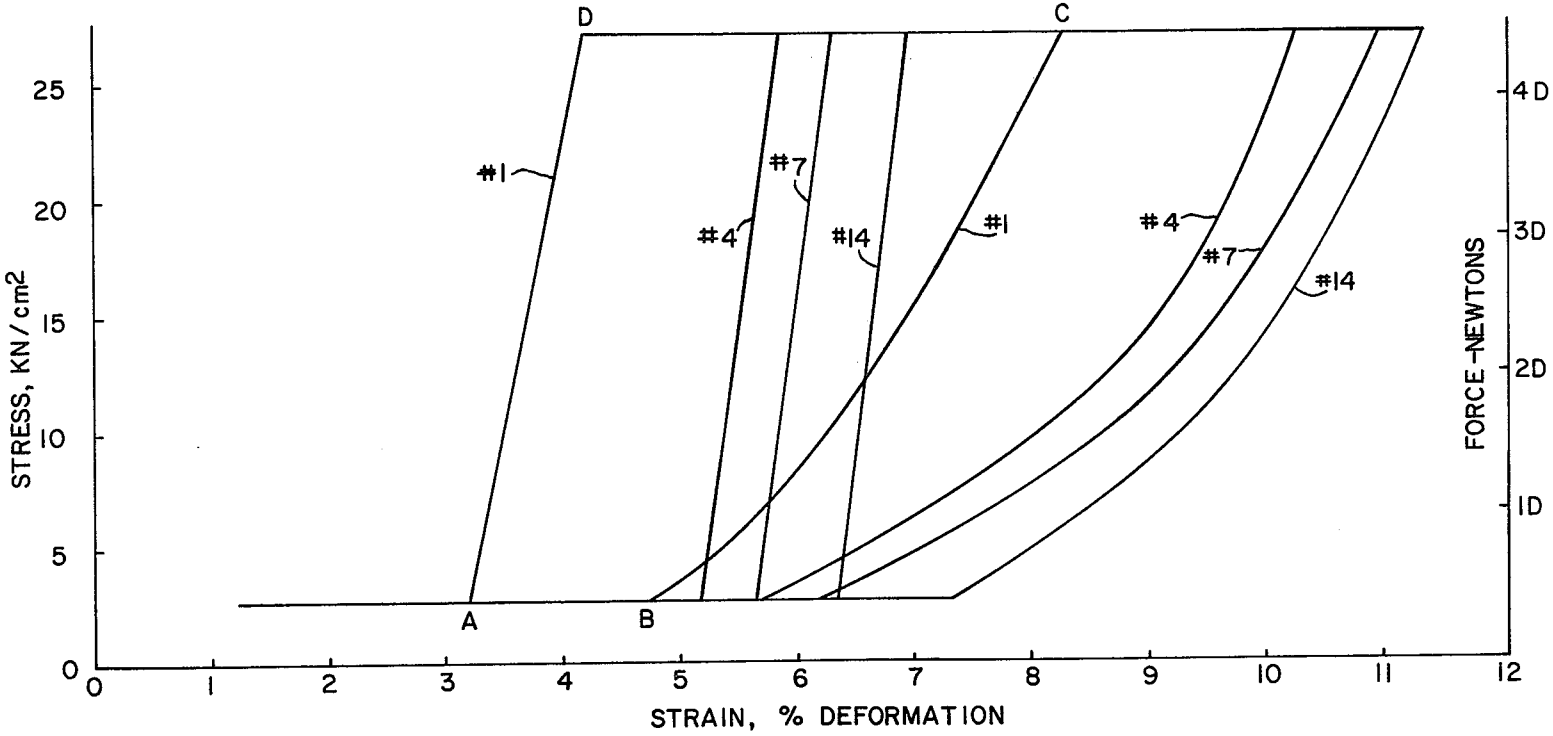
FIG. 2 is a stress-strain chart illustrating certain of the iterative steps in training the alloy.

The following comprises a specific example of the method of training a straight wire of Nitinol having a composition of 55% nickel by weight and 45% titanium by weight. Prior to training the Nitinol is annealed at about 550° Celsius to relieve internal stresses. The wire is without training history and is therefore "naive". The wire is 0.018" diameter, 20" in length and weighs 0.7 grams. The steps of the method of FIG. 1 are carried out on the wire for a total of fourteen cycles. The chart of FIG. 2 depicts the stress-strain diagrams for four selected cycles, namely cycle Nos. 1, 4, 7 and 14.

In the first cycle dipicted in Curve #1 of FIG. 2 the wire is cooled to $T_C$ of 5° C., which is below the transition temperature range of 20°–50° C. for the particular Nitinol which is employed. The wire is cooled under a minimal force of approximately 5 Newtons and a constant stress $\sigma_1$ of approximately 2.5 KN/cm$^2$ so that it elongates from point A to point B. In the next step an increasing force is applied to deform and stretch the wire under the constant temperature $T_C$. The wire elongates further as depicted from point B to point C on the curve, to the maximum force of 45 Newtons which applies a maximum training stress $\sigma_2$ of approximately 27 KN/cm$^2$. In the next step the wire is heated to a temperature $T_H$ of 95° C. which is above the upper operating temperature of the heat engine in which the alloy is to be employed. The wire is heated under a constant force of 45 Newtons at the $\sigma_2$ of 27 KN/cm$^2$ and contracts from point C to point D on the curve. In the next step the wire is held under a constant temperature $T_H$ while removing the force and diminishing the stress from point D to point A on the curve.

The wire is then trained through te remaining 13 cycles with each cycle comprising a cooling phase at minimal stress of 2.5 KN/cm$^2$ to a temperature of 5° C., a deformation phase by applying an increasing force at constant 5° C. temperature to the second training stress of 27 KN/cm$^2$, a heating phase of increasing the temperature to 95° C. under constant stress of 27 KN/cm $^2$ and a return phase by decreasing the stress to 2.5 KN/cm$^2$ under constant temperature of 95° C.

Following the training of the shape memory alloy by the foregoing method, the wire has a length, when above the transtition temperature range, which is 5% or more longer than it had before training, and has another length, when cooled below the transition temperature range, which is approximately 8% or more greater than it had before training. Such a wire does work (by contraction) when heated, and also does work (by expansion) when cooled. The amount of work done during cooling is generally less than the work available during heating because the modulus of elasticity of the cold phase (martensite) is generally smaller than that of the hot phase (parent phase or austenite). It is significant that the stress-strain characteristics of the alloy have been radically modified by the training process, as shown by comparing FIGS. 4 and 5.

It has been observed that some aspects of training normally occur in any shape memory engine cycle, and if naive Nitinol is used the behavior of the material will continue to change throughout many cycles so that the engine function changes as a function of number of cycles. However, and this is an important aspect of the present invention, the shape memory alloy, particularly Nitinol, may be pre-conditioned for use in a particular cycle so that its behavior in use is practically constant. This may be done by subjecting the memory alloy element to be used in the engine to a greater stress during pre-conditioning that it will encounter in actual use. Such pre-conditioning can be accomplished in a relatively few cycles, after which the behavior is essentially constant as long as the limited excursions in stress, strain and temperature which were used in the training method are not exceeded. This stabilization is an important aspect of the invention and, coupled with the two-way memory, constitutes a significant part of the invention. Training is optional if the training cycle includes a step in which the alloy does external work.

Figure 3:
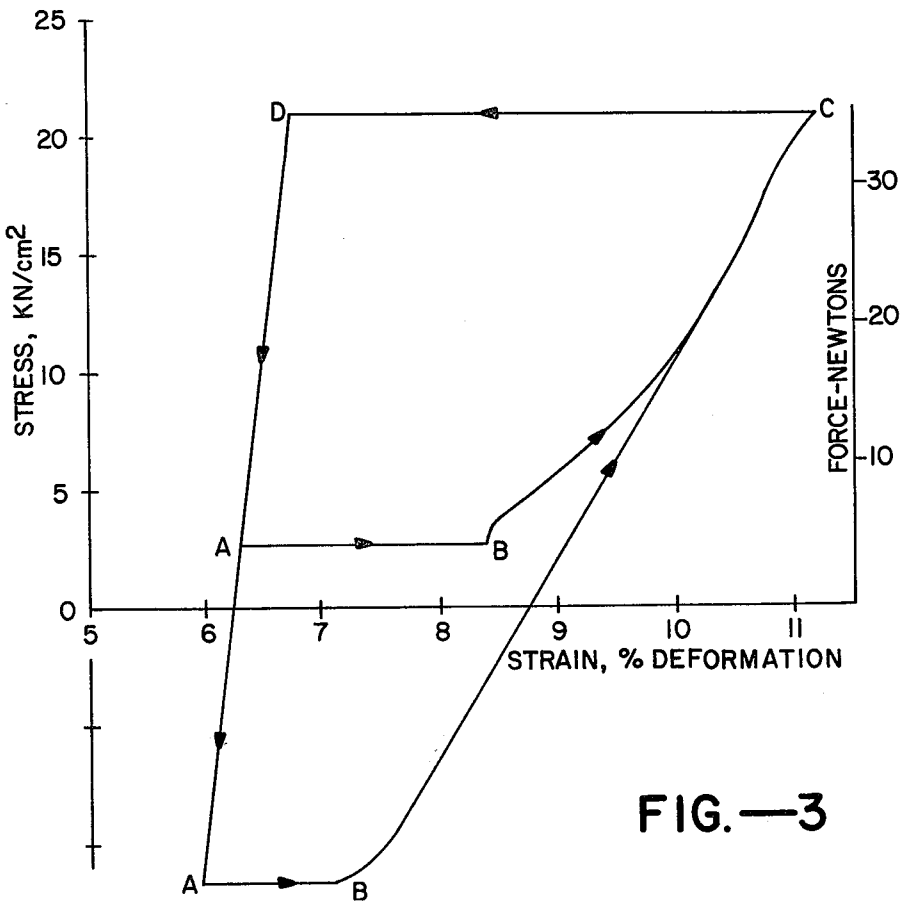
FIG. 3 is a stress-strain chart depicting the stabilized operating cycle for the trained alloy of the invention.

The chart of FIG. 3 depicts repetitive cycling (e.g. when used in a heat engine) of the Nitinol wire trained according to the steps depicted in the chart of FIG. 2. The stress-strain curve ABCDA depicts the results of repeated cycles under a stress $\sigma$ of 22 KN/cm$^2$ which is below the training stress $\sigma_T$. In the cooling step of each cycle from point A to point B on the curve the wire is cooled to 7° C. under a force of 5 Newtons and minimal stress of 2.5 KN/cm$^2$.

In the deformation step from point B to point C on the curve, and increasing force is applied up to 35 Newtons and the stress $\sigma$ of 22 KN/cm$^2$ while holding the temperature constant at 7° C. In the heating step from point C to point D, the wire is heated 85° C. under the constant stress $\sigma$ of 22 KN/cm$^2$ while contracting. In the step from point D to A on the curve, the force is releases to decrease the stress to 2.5 KN/cm$^2$ under constant temperature of 85° C.

Figure 4:
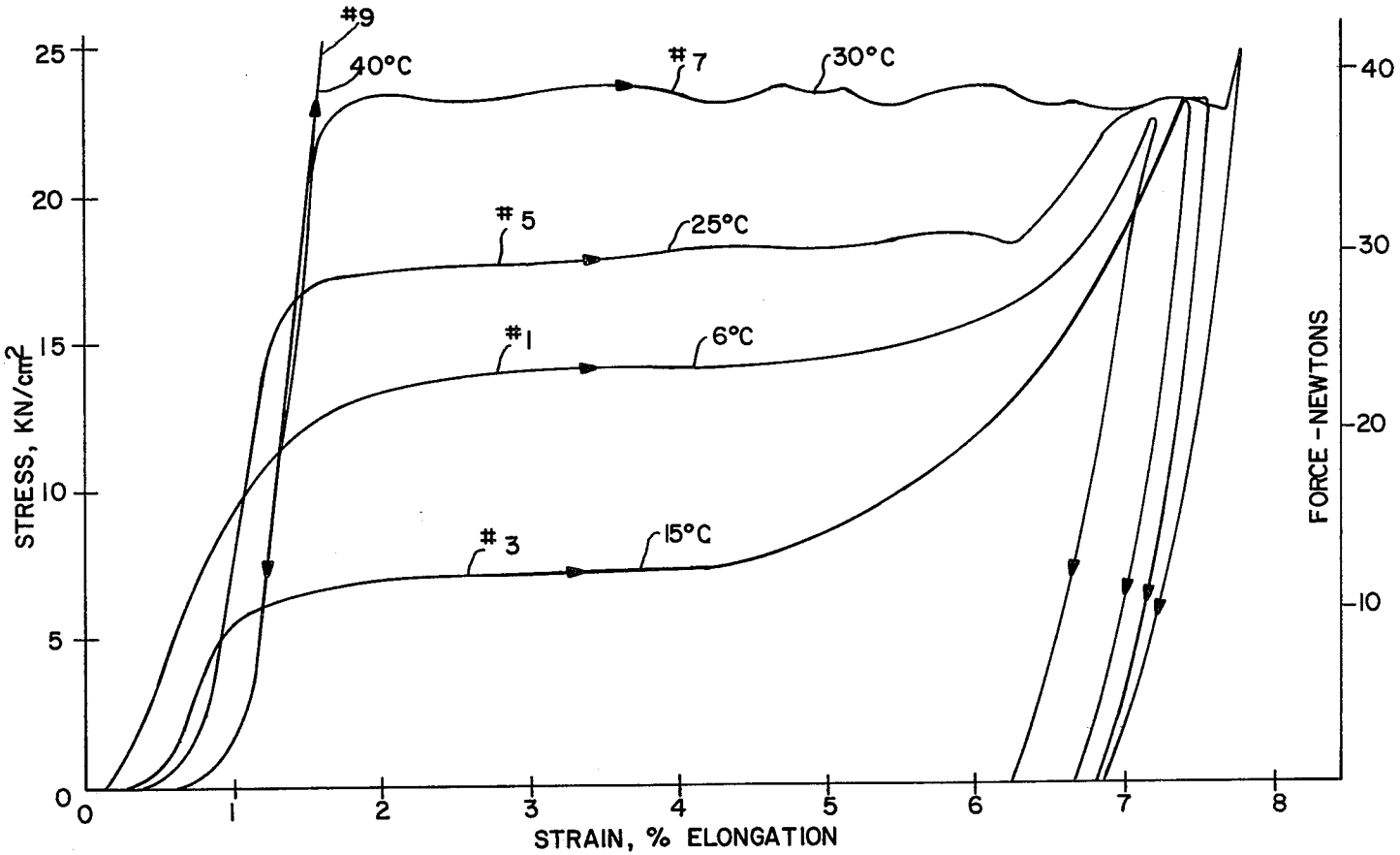
FIG. 4 is a stress-strain chart depicting isothermal cycles for an untrained naive memory alloy.
Figure 5:
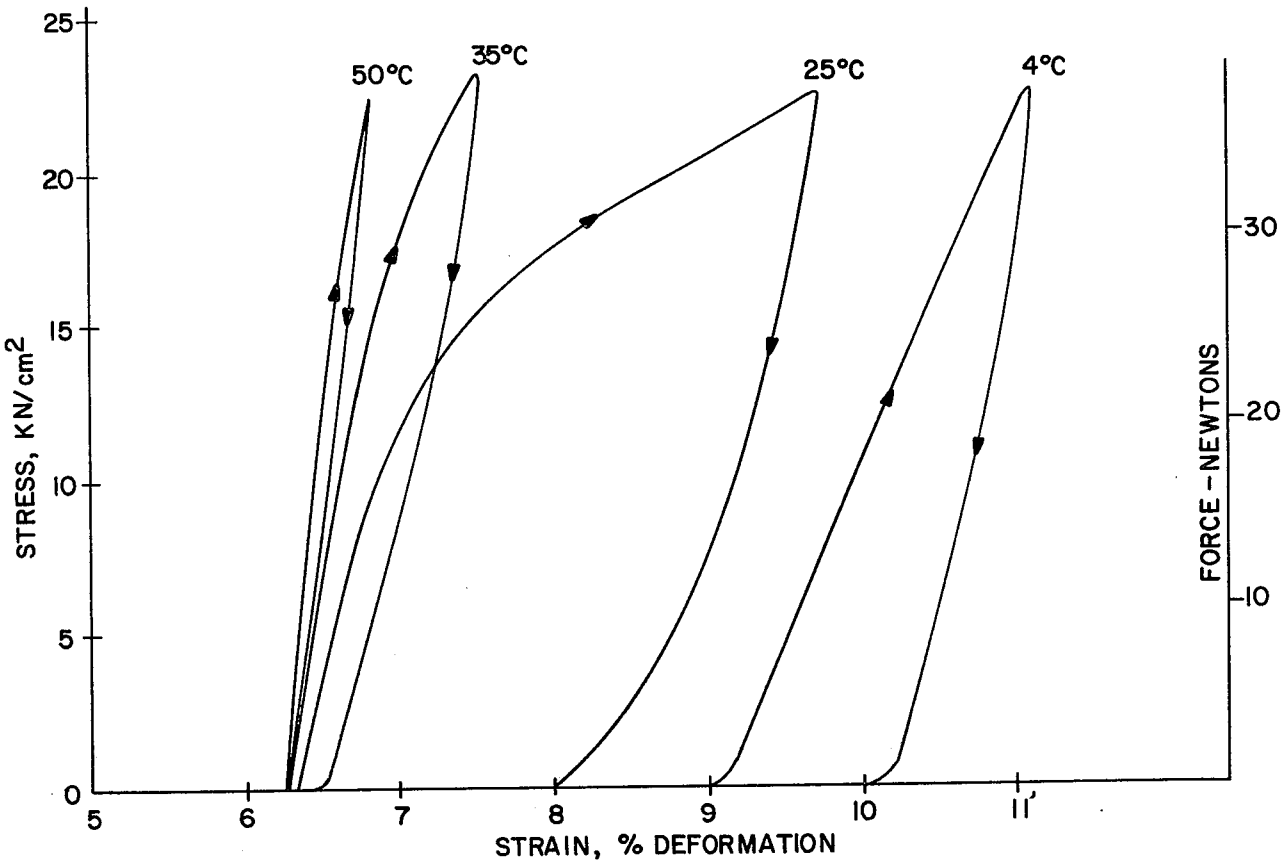
FIG. 5 is a stress-strain chart depicting isothermal cycles for a memory alloy trained in accordance with the present invention.

A graphic comparison of the results of the present invention can be readily observed from the charts of FIGS. 4 and 5. FIG. 4 is a series of stress-strain curves for an untrained, naive Nitinol wire of the same composition, diameter, length and weight as the wire described in connection with FIGS. 2 and 3. The naive wire is heated and cooled through eleven cycles, of which cycle Nos. 1, 3, 5, 7, and 9 are depicted in FIG. 4. The wire is cooled in Cycle 1 to a temperature of 6° C., in Cycle 3 to 15° C., in Cycle 5 to 25° C., in Cycle 7 to 30° C. and in Cycle 9 to 40° C. In each cycle the wire is pulled to a stress in the range of 22.5–25 KN/cm$^2$, and then heated to approximately 90° C. with the stress near zero.

The chart of FIG. 5 depicts the stress-strain characteristics of a Nitinol wire (of the same composition, diameter, length and weight of the wire for FIGS. 2–4) which has been trained in accordance with the present invention through twenty-one cycles at a cooling temperature of 5° C., a heating temperature of 95° C., a stretching force of from 35–45 Newtons, and a minimal force of 5 Newtons. The trained wire is then operated through ten cycles, as depicted by the curve ABCDA in FIG. 3.

Training of Nitinol elements by torsional deformation results in similar behavior, and with the advantages that work in a cycle can be derived during transition to cold phase as well as to hot phase due to the better configuration. Such a cycle is depicted by the curve A'B'CDA' in FIG. 3.

The curve A'B'CDA' also demonstrates that in certain modes of deformation, e.g. torsion and shear, the raining stress can be both positive and negative. Thus the first and second training stresses could be applied in opposite senses by cyclically twisting a bar in torsion in opposite directions, or by cyclically twisting a hollow cylinder in shear in opposite directions, or by cyclically applying tension and compression to a solid bar. Additionally the first and second training stresses could be applied in the same sense, but at different magnitudes. Thus either the bar or hollow cylinder could be initially twisted in one direction to a point setting up the first training stress and then further twisted in the same direction to another point for the second training stress. A wire could similarly be intially pulled in tension at the first training stress and then pulled further in tension to the second training stress, or a solid bar could be cyclically compressed to different training stresses.

In comparison with the present invention, the curves of FIG. 2 illustrate that the untrained, naive Nitinol produces a behavior in which the performance during repeated cycling cannot be predicted. The shape memory alloy trained in accordance with the present invention produces predictable curves for repeated cycles as depicted in FIG. 3.

Figure 6:
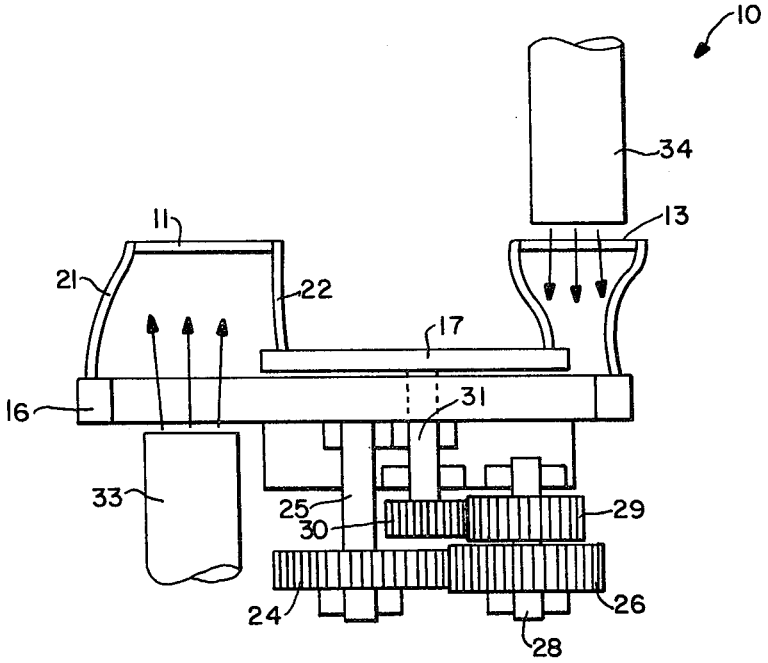
FIG. 6 is a side elevation view of a simplified form of a heat engine incorporating the invention.
Figure 7:
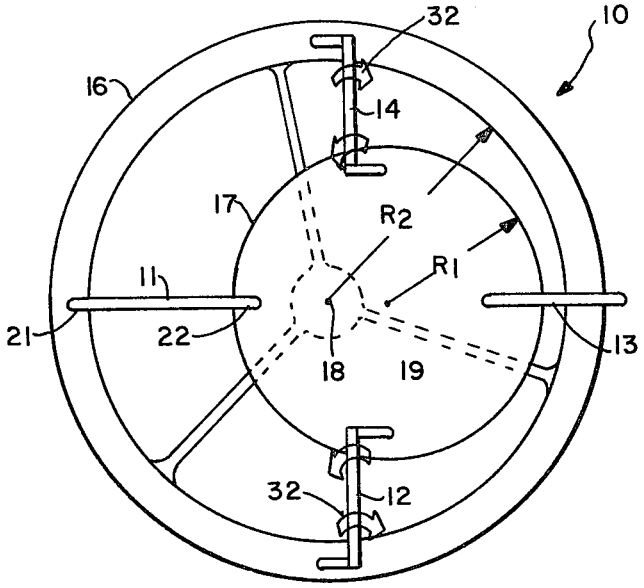
FIG. 7 is a top plan view of the engine of FIG. 6.

FIGS. 6 and 7 illustrate in simplified form a heat engine embodiment of the invention incorporating a two-way shape memory alloy trained in accordance with the invention. Heat engine 10 comprises a plurality of elongate cylindrical elements 11–14 composed of the two-way shape memory Nitinol alloy. Opposite ends of the Nitinol elements cyclically deform in torsion when heated above and cooled below the transition temperature. Means is provided for constraining the opposite ends of the elements so that for each cycle the elements deform torsionally first in one rotational sense during the heating phase and then deform torsionally in the opposite rotational sense during the cooling phase of the cycle. In this embodiment the constraining means comprises at least a pair of juxtaposed wheels 16, 17 mounted for rotation about non-concentric parallel axes 18, 19. The wheel 17 has a radius $R_1$ and the outer wheel 16 has a larger radius $R_2$. The Nitinol elements are disposed generally radially of the wheels and opposite ends of the elements are carried between adjacent portions of the wheels by elastic arms 21, 22 which are adapted to flex when the elements torsionally deflect. The elastic arms store some energy as they cyclically flex and then relax to release the energy into mechanical work on the wheels.

Means is provided for coupling the wheels for equal angular rotation and comprises two sets of intermeshing gears. Gear 24 of the first set is carried for rotation with outer wheel 16 by shaft 25 and meshes with gear 26 which is fixed for rotation on shaft 28 with gear 29 of the second set. Gear 29 meshes with gear 30 which in turn is fixed for rotation with inner wheel 17 on shaft 31. During rotation because the inner wheel has a different center of rotation than the outer wheel the opposite ends of the Nitinol elements are deformed torsionally in the manner depicted by the arrows 32 in FIG. 7. During one-half of the cycle heat is applied by a hot fluid, e.g. a gas or liquid, directed through conduit 33. As the elements are heated above their transition temperature they torsionally deform due to the shape memory effect. During the other half of the cycle a cold fliud, e.g. a gas or liquid, is directed through conduit 34 to cool the elements below their transition temperature. The elements torsionally deform in the opposite direction due to the two-way shape memory effect. In both halves of the cycle, the elements do positive work on the wheels, causing them to rotate and thereby continually carry the elements into the steams of hot and cold fluids. Output power can be taken from the engine by a suitable coupling, not shown, with the wheel shafts or gears.

Figure 8:
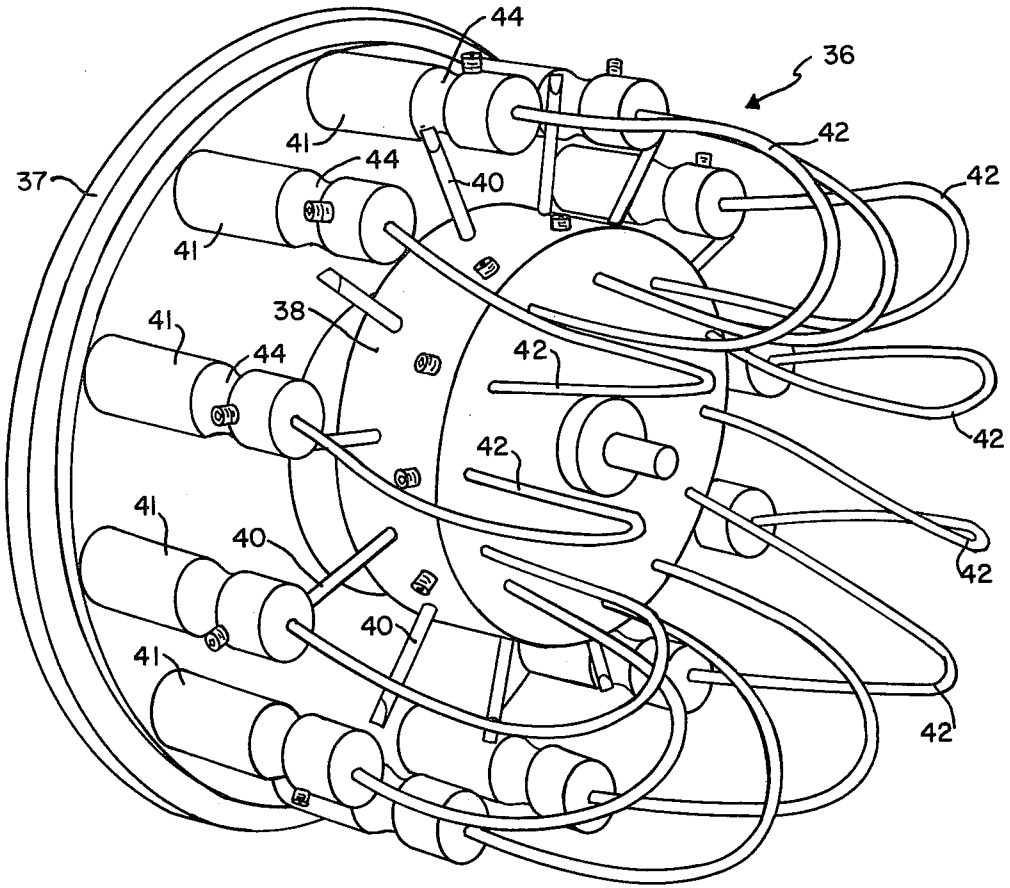
FIG. 8 is a perspective view of another form of a heat engine incorporating the invention.

FIG. 8 illustrates another embodiment of the invention similar to the embodiment of FIGS. 6 and 7 but employing a larger number of Nitinol elements circumferentially spaced around the wheels. In this embodiment the heat engine 36 includes a pair of wheels 37, 38 which are mounted for rotation about parallel spaced-apart axes and are coupled for equal angular rotation by a plurality of radially extending spokes 40. A plurality of axially extending posts 41 are mounted about outer wheel 37. A plurality of two-way shape memory Nitinol elements 42, trained in accordance with the present invention, are mounted between the wheels. Each element comprises a wire formed in a loop with its inner end connected to the outer rim of wheel 38 and with its outer end connected to a respective post 41 on the outer wheel. The radially extending spokes 40 are mounted on the inner wheel and the spokes are adapted to move, at the upper end of the engine, into contact with grooves 44 formed in the posts. A suitable conduit, not shown, is provided to direct a stream of hot fluid across the outer portions of the elements on one side of the engine, and another conduit, not shown, is provided to direct a stream of cold fluid against the outer portions of the elements on the opposite side of the engine. As the outer portions of the elements on the first side are heated above the transition temperature they torsionally deform in the manner explained in relation to FIGS. 6 and 7, and similarly as the elements are cooled below their transition temperature on the opposite side they torsionally deform in the opposite direction. As the elements deform on both sides they exert a force on the wheels, the net result of which causes continuous rotation of the wheels to produce work.

The invention also contemplates that the two-way shape memory alloy incorporated in a heat engine could also be in the form of a hollow cylinder, or a flat bar, or a spiral or helical configuration so that the two-way deformation of the element applies a force producing work. Additionally, means other than the wheels of the illustrated embodiments could be employed, such as circular tracks and the like, for cyclically bringing the memory alloy elements into contact with the heating means during one phase and then into contact with the cooling means during another phase. Further, other heating and cooling means could be employed, such as radiant or electrical energy.

While the foregoing embodiments are at present considered to be preferred it is understood that numerous variations and modifications may be made therein by those skilled in the art, and it is intended to cover in the appended claims all such variations and modifications as fall within the true spirit and scope of the invention.

What is claimed is:

1. A method of training a shape memory alloy so that the alloy has a two-way shape memory when the alloy is operated in a working cycle for converting heat into mechanical work with the conditions of the cycle including an upper operating temperature T of the alloy and a stress $\sigma_w$ at which the alloy is operated in the working cycle, the method comprising iteratively performing the steps of heating the alloy under a first training stress $\sigma_1$ to a temperature $T_H$ which is above said temperature T, cooling the alloy to a temperature $T_C$ which is below the zero-force transition temperature of the alloy, deforming the alloy at $T_C$ while applying to the alloy a second training stress $\sigma_2$where $\sigma_2 \neq \sigma_1$ and $\sigma_2 \geqq \sigma_w$, heating the alloy back to $T_H$, and changing stress on the alloy to the first training stress.

2. A method as in claim 1 in which the first training stress is applied in an opposite sense from the second training sense.

3. A method as in claim 2 in which said training stresses are applied in torsion.

4. A method as in claim 2 in which said training stresses are applied in tension and compression.

5. A method as in claim 2 in which said training stresses are applied in shear.

6. A method as in claim 1 in which the training stresses are applied in the same sense and in which the stresses are of different magnitude.

7. A method as in claim 6 in which said training stresses are applied in torsion.

8. A method as in claim 6 in which said training stresses are applied in tension or compression.

9. A method as in claim 6 in which said training stresses are applied in shear.

10. A method as in claim 1 in which the shape memory alloy comprises Nitinol having a composition of substantially 55% nickel by weight and substantially 45% titanium by weight.

11. A method as in claim 10 in which the alloy is deformed substantially 3% dimensionally by the training stresses.

12. A method as in claim 10 in which one of the training stresses is substantially 30 Kpsi.

13. A method as in claim 10 in which $T_H$ is substantially 95° C. and $T_C$ substantially 5° C.

14. A method as in claim 10 in which the alloy is deformed substantially 3% dimensionally by applying said training stresses, one of said stresses is at substantially 30 Kpsi, said $T_H$ is substantially 95° C. and said $T_C$ is substantially 5° C.

15. A shape memory alloy having a two-way shape memory which produces mechanical work during both heating and cooling cycles when operated in a shape memory alloy heat engine with the conditions including an operating temperature T of the alloy and a stress $\sigma_w$ at which the alloy is operated in the working cycle, said alloy being formed by the method of iteratively performing the steps of heating a naive shape memory alloy under a first training stress $\sigma_1$ to a temperature $T_H$ which is above the upper operating temperature T of the alloy, cooling the alloy to a temperature $T_C$ which is below the zero-force transition temperature of the alloy, deforming the alloy at $T_C$ while applying a second training stress $\sigma_2$ where $\sigma_2 \neq \sigma_1$ and $\sigma_2 \geqq \sigma_w$, heating the alloy back to $T_H$, and changing stress on the alloy to the first training stress.

16. A shape memory alloy formed by the method of claim 15 in which the first training stress is applied in an opposite sense from the second training stress.

17. An alloy formed by the method of claim 16 in which said training stresses are applied in torsion.

18. An alloy formed by the method of claim 16 in which said training stresses are applied in tension and compression.

19. An alloy formed by the method of claim 16 in which said training stresses are applied in shear.

20. An alloy formed by the method of claim 15 in which the training stresses are applied in the same sense and in which the stresses are of different magnitude.

21. An alloy formed by the method of claim 20 in which said training stresses are applied in torsion.

22. An alloy formed by the method of claim 20 in which said training stresses are applied in tension or compression.

23. An alloy formed by the method of claim 20 in which said training stresses are applied in shear.

24. A shape memory alloy formed by the method of claim 15 in which the naive alloy comprises Nitinol having a composition of substantially 55% nickel by weight and substantially 45% titanium by weight.

25. An alloy formed by the method of claim 24 in which the alloy is deformed substantially 3% dimensionally while applying said training stresses.

26. An alloy formed by the method of claim 24 in which one of said training stresses is substantially 30 Kpsi.

27. An alloy formed by the method of claim 24 in which $T_H$ is substantially 95° C. and $T_C$ is substantially 5° C.

28. An alloy formed by the method of claim 24 in which the naive alloy is deformed substantially 3% dimensionally by applying said training stresses, one of said stresses is substantially 30 Kpsi, said $T_H$ is substantially 95° C. and $T_C$ is substantially 5° C.

* * * * *